US006751427B2

(12) United States Patent
Sugiura

(10) Patent No.: US 6,751,427 B2
(45) Date of Patent: Jun. 15, 2004

(54) CHARGING MEMBER, FACING MEMBER, AND IMAGE FORMING APPARATUS USING THE SAME

(75) Inventor: Kenji Sugiura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 10/138,633

(22) Filed: May 6, 2002

(65) Prior Publication Data

US 2002/0172525 A1 Nov. 21, 2002

(30) Foreign Application Priority Data

May 7, 2001 (JP) ..... 2001-135871

(51) Int. Cl.[7] ..... G03G 15/02

(52) U.S. Cl. ..... 399/100; 399/168; 399/175; 399/176

(58) Field of Search ..... 399/98, 99, 100, 399/168, 175, 176

(56) References Cited

U.S. PATENT DOCUMENTS 5,610,691 A * 3/1997 Takahashi et al. ..... 399/100 X
5,678,136 A * 10/1997 Watanabe et al. ..... 399/100
5,943,533 A * 8/1999 Ogata et al. ..... 399/100 X
6,088,551 A * 7/2000 Satoh et al. ..... 399/100
6,334,034 B1 * 12/2001 Kitazawa et al. ..... 399/100

FOREIGN PATENT DOCUMENTS

| | | |
|---|---|---|
| JP | 7-199604 | 8/1995 |
| JP | 8-62948 | 3/1996 |
| JP | 10-288881 | 10/1998 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A charger of the present invention includes a charging member contacting or adjoining an image carrier for charging the image carrier. A conductive facing member faces a portion of the charging member other than a portion of the same that faces the image carrier. Discharge occurs between the charging member and the facing member to thereby remove impurities deposited on the charging member. An image forming apparatus including the charger is also disclosed.

18 Claims, 7 Drawing Sheets

FIG. 7
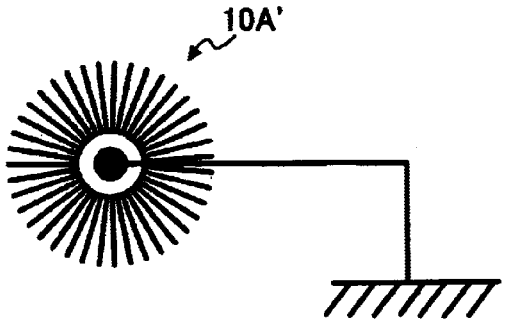
FIG. 8
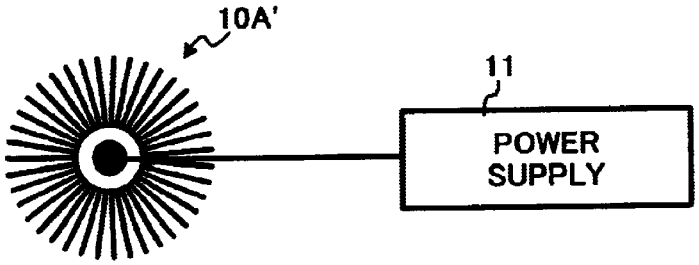
FIG. 9
| NO. | CONDITION | ROLLER SURFACE |
|---|---|---|
| 1 | INSULATIVE BRUSH | PARTLY PALE WHITE |
| 2 | MEDIUM RESISTANCE BRUSH | NO IMPURITIES DEPOSITED |

FIG. 10

| NO. | CONDITION | ROLLER SURFACE |
|---|---|---|
| 1 | NO FACING MEMBER | ENTIRELY WHITE |
| 2 | INSULATIVE BRUSH | ENTIRELY PALE WHITE |
| 3 | MEDIUM RESISTANCE BRUSH NOT GROUNDED | PARTLY PALE WHITE |
| 4 | MEDIUM RESISTANCE BRUSH GROUNDED | PARTLY PALE WHITE |
| 5 | MEDIUM RESISTANCE BRUSH ( BIAS OF DC 0.8 V ) | NO IMPURITIES DEPOSITED |

CHARGING MEMBER, FACING MEMBER, AND IMAGE FORMING APPARATUS USING THE SAME

BACKGROUND OF THE INVENTION

1. Field of the Invention

The present invention relates to an image forming apparatus and more particularly to a charger included in an image forming apparatus and free from irregular charging.

2. Description of the Background Art

Generally, a copier, printer, facsimile apparatus, printer or similar image forming apparatus includes a charger for uniformly charging the surface of a photoconductive element or similar image carrier. A latent image is formed on the charged surface of the image carrier in accordance with image data and then developed to become a toner image. The toner image is transferred from the image carrier to a sheet or recording medium. A fixing unit fixes the toner image on the sheet to thereby produce a print.

A non-contact type of charging system using the corona discharge of a charger is one of conventional charging systems. The problem with this type of charging system is that it produces discharge products including ozone and nitrogen oxides. Ozone with high density staying in the image forming apparatus oxidizes the surface of the image carrier and thereby lowers the sensitivity and chargeability of the image carrier, resulting in low image quality, as reported in the past. Further, ozone accelerates the deterioration of other various members as well and thereby reduces the service lives thereof.

On the other hand, nitrogen oxides resulting from discharge react to moisture present in the air to thereby produce nitric acid and react to, e.g., metal to thereby produce a metal nitrate. While such products have high resistance in a low humidity environment, the resistance decreases in a high humidity environment because the products react to moisture present in the air. A thin film of nitric acid or that of metal nitrate formed on the image carrier makes an image blurred or otherwise defective. This is because the resistance of the above film decreases due to the adsorption of moisture to thereby destroy a toner image formed on the image carrier.

Moreover, nitrogen oxides stay without being decomposed in the air. As a result, compounds derived from nitrogen oxides continuously deposit on the image carrier even when charging is not effected, i.e., even during an interval between consecutive processes. The compounds penetrate into the image carrier little by little as the time elapses, constituting one of major causes of deterioration of the image carrier.

It has been customary to remove deposits from the image carrier by shaving the element little by little during cleaning. This kind of scheme, however, increases the cost and brings about deterioration due to aging.

Another conventional charging system is a contact type of charging system in which a charge roller, a charge brush or similar charging member contacts or adjoins, but does not contact, the image carrier. This type of charging system is disclosed in, e.g., Japanese Patent Laid-Open Publication Nos. 57-178257, 56-104351, 58-40566, 58139156, 58-150975, 63-7380 and 2000-242064. The contact type of charging system is contrastive to the non-contact type of charging system in that it produces a minimum of ozone, reduces the power supply cost because of low required voltage, and facilitates the design of electric insulation. Of course, the contact type of charging system is free from the problems ascribable to nitrogen oxides.

More specifically, in the contact type of charging system, the charger charges the image carrier on the basis of the migration of charge when contacting the element or charges it on the basis of gaseous discharge when adjoining it. During charging, a voltage higher than one applied at the beginning of charging is applied to the image carrier. Also, an AC voltage is superposed on a DC voltage corresponding to a target charge potential, so that an oscillation voltage is applied to the photoconductive element. The AC voltage obviates an irregular potential distribution ascribable to resistance and instability during charging that the DC voltage cannot cope with alone. Japanese Patent Laid-Open Publication No. 8-106200, for example, describes charging of the kind using charge migration specifically. Japanese Patent Laid-Open Publication No. 63-149669, for example describes charging of the kind using oscillation voltage in detail.

In the contact type of charging system using a charge roller as a conductive member, the charge roller is, in many cases, made up of a conductive core and conductive rubber covering the surface of the core as a charge supply layer. Conductive rubber, however, brings about the following problems. Assume that the image forming apparatus is not operated over a long time with the charge roller contacting the image carrier. Then, part of the conductive rubber elastically deformed in contact with the image carrier permanently deforms. As a result, when the charge roller is rotated later, it cannot uniformly charge the image carrier by charge migration because its diameter is not uniform. In addition, rubber itself is highly water-absorptive and therefore noticeably varies in resistance in accordance with the environment, further obstructing uniform charging.

Apart from the deformation and water absorption of rubber, the composition of rubber itself sometimes obstructs uniform charging, as will be described hereinafter. Rubber needs some different kinds of plasticizers and activators for exhibiting elasticity and coping with deterioration. In addition, a dispersion promoting agent is sometimes added to rubber in order to disperse a conductive pigment. On the other hand, the surface of the image carrier is, in many cases, formed of polycarbonate resin, acrylic resin or similar amorphous resin. The amorphous resin is easily influenced by the plasticizers, activators and dispersion promoting agent contained in rubber, making it difficult to uniformly charge the image carrier. Moreover, impurities are apt to enter the nip between the image carrier and the charge roller and contaminate the charge roller, resulting in defective charging. Particularly, when the image carrier and charge roller are held in contact over a long time, the impurities contaminate the image carrier and are likely to produce horizontal stripes or similar defects in an image.

The charge roller adjoining, but not contacting, the image carrier solves the problems with the charge roller contacting the same discussed above. However, even the charge roller adjoining the image carrier has the following problems left unsolved. Generally, in a developer used for development, silica is coated on the surfaces of toner grains in order to enhance efficient image transfer and image quality and to stabilize image quality without regard to the number of times of image formation repeated. Although toner is expected to be transferred to a sheet during image transfer, it is not fully transferred, but partly remains on the image carrier.

An image forming cycle includes a cleaning step for removing the toner left on the image carrier after image transfer as well as paper dust and other impurities deposited on the image carrier during image transfer. The cleaning step, however, sometimes fails to remove silica coated on the toner grains and paper dust because they are far small in size than the toner grains. When part of the image carrier moved away from a cleaning station arrives at the charger, silica and paper dust deposit on the charge roller adjoining the image carrier and thereby obstruct uniform charging. Particularly, an electrostatic force derived from gaseous discharge aggravates the deposition of silica and paper dust on the charge roller.

The phenomenon described above is more conspicuous when the AC-biased DC voltage is applied than when the DC voltage is applied alone, as known in the art. This is because a medium resistance layer included in the charge roller discharges a far greater number of times in the case of the AC-biased DC voltage than in the case of the DC voltage. Particularly, a precondition with the charge roller is that the medium resistance layer controls the energy of a single fine discharge for thereby effecting uniform charging. However, when silica and paper dust cover the entire charge roller, the medium resistance layer fails to exhibit its function and causes discharge with great energy to occur, resulting in a scale-like irregular charge pattern.

I conducted a series of experiments relating to the above phenomenon and obtained the following results. For experiments, use was made of a modified version of a copier imagio 450 (trade name) available from RICOH CO., LTD. A bias was implemented as a DC voltage (identical with a charge potential) biased by an AC voltage (constant voltage controlled). An image forming cycle was repeated with the copier in a condition wherein a cleaning device was mounted and a condition wherein it was removed to unable cleaning.

When the cleaning device was absent on the copier, the surface of a charge roller partly whitened. The resistance of the whitened portion was higher than the resistance of a fresh charge roller by a range of about one figure. When the whitened portion was shaved off and analyzed, substances presumably derived from silica and paper dust were found and included Si atoms and Ca atoms. This indicated that silica and paper dust deposited on the whitened portion of the charge roller. As the image forming cycle was further repeated, toner deposited on the background of an image although it was small in amount. At last, irregularity presumably ascribable to irregular charging occurred in the halftone portion of an image.

A fresh charge roller and the charge roller held in the above conditions were compared as to the flow of a current. In the case of the charge roller in the condition wherein cleaning could not be effected, a current flew through the roller in the form of pulses and caused abnormal discharge entirely different from uniform charge to occur; the absolute value of the peak crest was sometimes as great as 0.7 mA. Such a current therefore failed to uniformly charge the surface of an image carrier. This result of comparison will be described more specifically later.

While a block of sponge or a brush may be used to remove silica and paper dust from the charge roller, it cannot remove the entire silica and paper dust whose grain sizes are extremely small.

Silica and paper dust deposited on the charge roller cause the surface resistance of the charge roller to vary and particularly increase the apparent resistance of the roller because they are electric resistors. It follows that when a charge potential on the surface of an image carrier is set, the voltage to be applied to the charge roller must be higher than the usual voltage. Particularly, it is necessary to raise the bias voltage in the case of the DC voltage or to increase the amplitude of the AC component in the case of the AC-biased DC voltage. This aggravates power consumption and makes bias control sophisticated. Further, even if the characteristic relating to bias voltage is changed, periodic irregular charging occurs in the portion of the charge roller where silica and paper dust are present, preventing the image carrier from being uniformly charged. Moreover, the high apparent resistance on the surface of the charge roller shifts the resistance variation dependent on the environment toward the high resistance side, increasing the change of the bias required to absorb the environment-dependent variation. This also requires a power supply assigned to the charge roller to have a sufficient margin and therefore increases the cost of the image forming apparatus.

Technologies relating to the present invention are also disclosed in, e.g., Japanese Patent Laid-Open Publication Nos. 7-199604, 8-62948 and 10-288881.

SUMMARY OF THE INVENTION

It is an object of the present invention to provide a charger capable of obviating, when including a charging member implemented as a roller, defective charging ascribable to silica, paper dust and other impurities transferred from an image carrier, sophisticated control and an increase in cost, and an image forming apparatus using the same.

A charger of the present invention includes a charging member contacting or adjoining an image carrier for charging the image carrier. A conductive facing member faces a portion of the charging member other than a portion of the same that faces the image carrier. Discharge occurs between the charging member and the facing member to thereby remove impurities deposited on the charging member.

An image forming apparatus including the charger is also disclosed.

Further, a method of charging an image carrier of the present invention includes the steps of causing a charging member to contact or adjoin the image carrier, causing a facing member to face a portion of the charging member other than a portion of the same that faces the image carrier, and causing discharge to occur between the charging member and the facing member for thereby removing impurities deposited on the charging member.

BRIEF DESCRIPTION OF THE DRAWINGS

The above and other objects, features and advantages of the present invention will become more apparent from the following detailed description taken with the accompanying drawings in which:

FIG. 7 shows the facing member of FIG. 6 connected to ground;

FIG. 8 shows an arrangement for applying a bias to the facing member of FIG. 6;

FIG. 9 is a table showing the results of experiments conducted with different facing members;

FIG. 10 is a table showing the results of experiments conducted to determine the electric characteristics of some different facing members.

DESCRIPTION OF THE PREFERRED EMBODIMENT

Figure 1A:
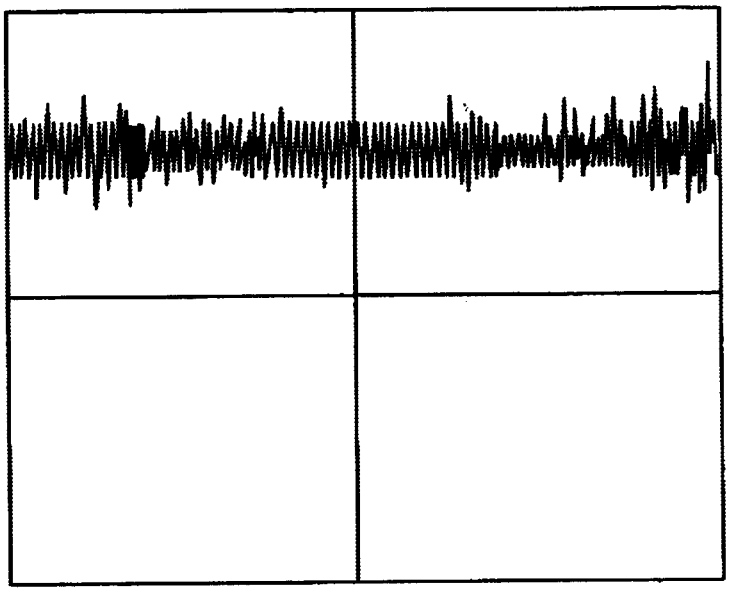
FIG. 1A shows a current flown through a fresh charge roller.
Figure 1B:
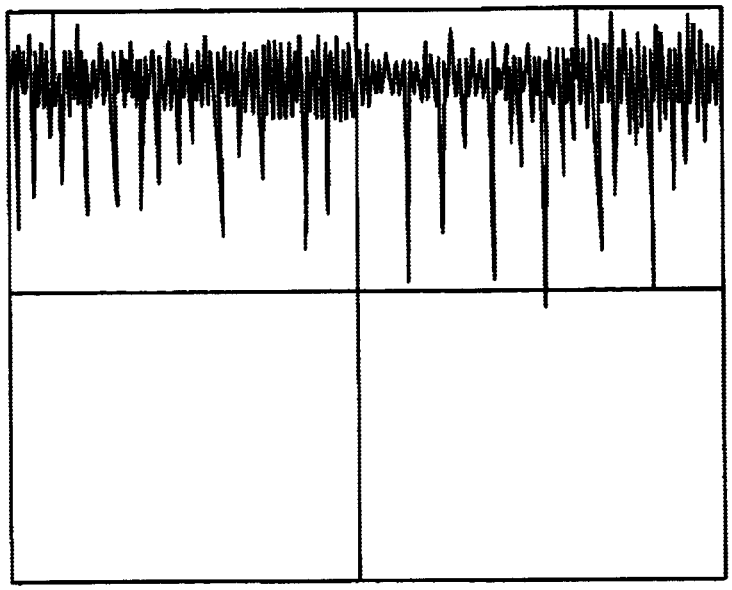
FIG. 1B shows a current flown through a charge roller repeatedly used in a condition wherein a cleaning function was not available.

FIG. 1A shows a current flown through a fresh charge roller while FIG. 1B shows a current flown through a charge roller held in a condition lacking a cleaning step. As shown, in the case of the charge roller in the cleaning-less condition, a current flew through the roller in the form of pulses and caused abnormal discharge entirely different from uniform charge to occur; the absolute value of the peak crest was sometimes as great as 0.7 mA, as stated earlier. As a result, the surface resistance of the whitened charge roller noticeably varies, making it difficult to implement sufficient charge that promotes charge migration in a medium resistance layer.

Figure 2A:
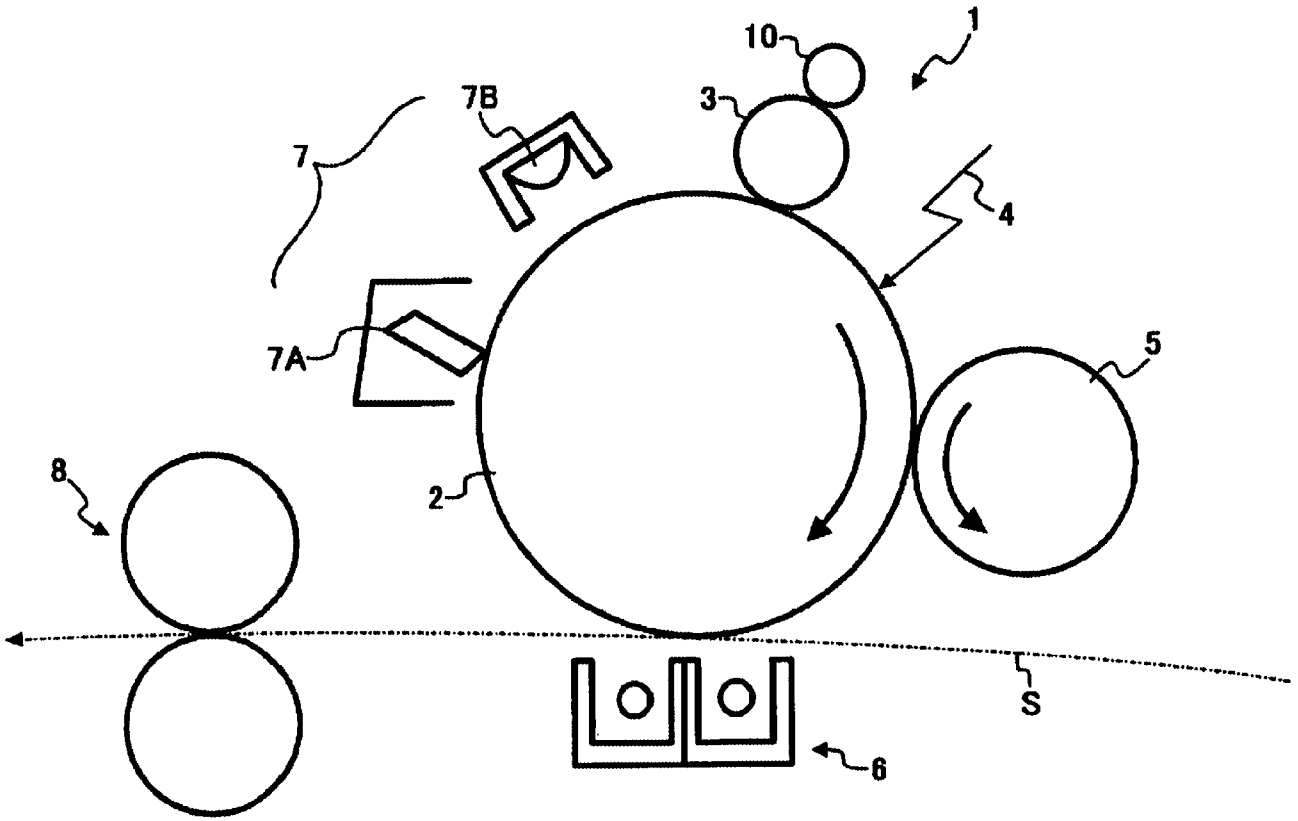
FIG. 2A is a view showing an image forming apparatus applied to monochromatic images and including a charger embodying the present invention.
Figure 2B:
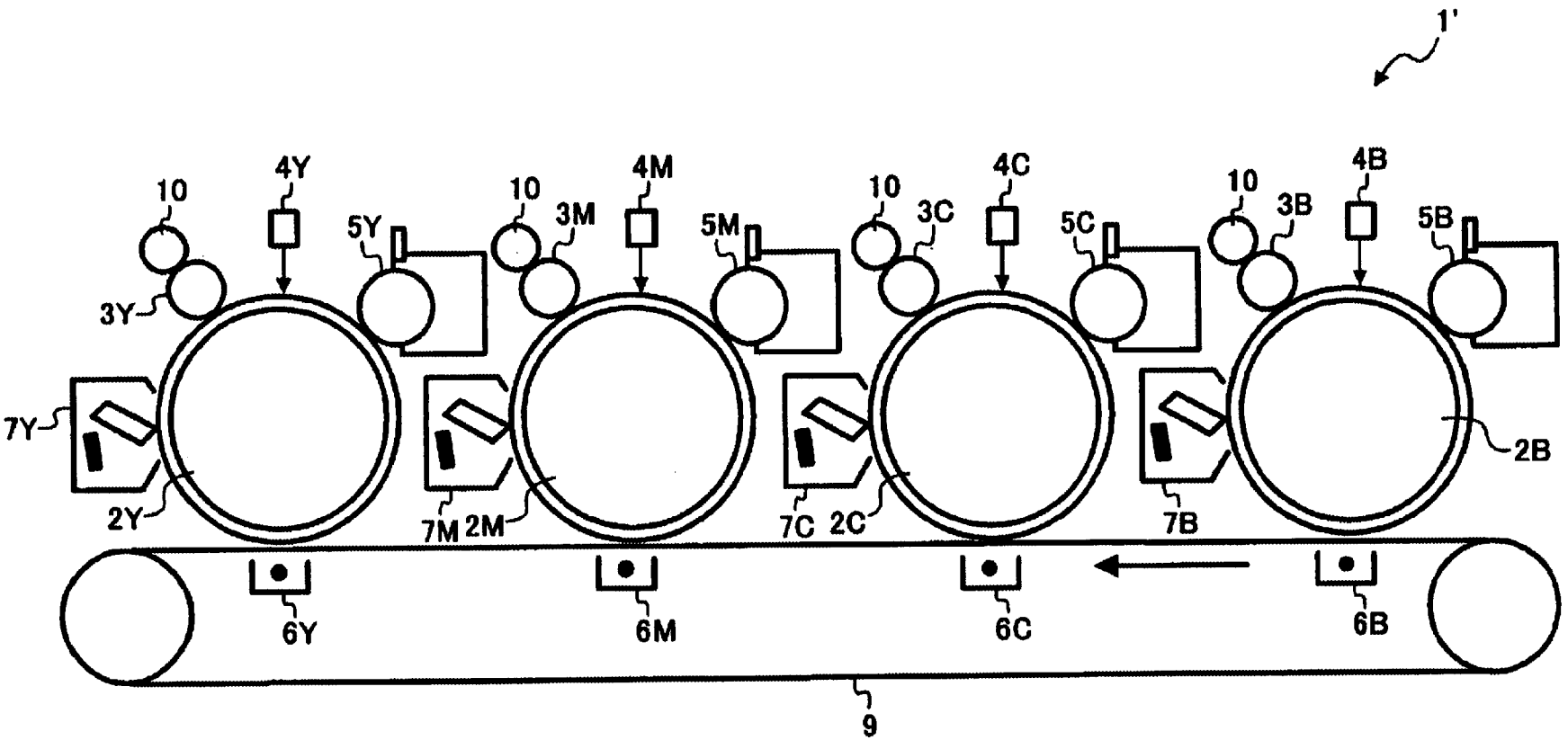
FIG. 2B is a view showing the illustrative embodiment applied to full-color images.

Referring to FIG. 2A, an image forming apparatus including a charger embodying the present invention is shown and implemented as a monochromatic image forming apparatus. As shown in FIG. 2B, the image forming apparatus maybe implemented as a full-color image forming apparatus also.

As shown in FIG. 2A, the image forming apparatus, generally 1, includes a photoconductive drum 2, which is a specific form of an image carrier, rotatable in a direction indicated by an arrow. A charger 3, an optical writing device represented by a light beam 4, a developing device 5, an image transferring device 6, and a cleaning device 7 are sequentially arranged in this order in the direction of rotation of the drum 2.

In operation, the charger 3 uniformly charges the surface of the drum 2. The optical writing device 4 scans the charged surface of the drum 2 with the light beam in accordance with image data to thereby form a latent image. The developing device 5 develops the latent image for thereby producing a corresponding toner image. The image transferring device 6 transfers the toner image from the drum 2 to a sheet S fed from a sheet feeder not shown. The fixing device 8 fixes the toner image on the sheet S. Thereafter, the sheet or pint S is driven out to a tray not shown.

More specifically, the developing device 5 uses either one of toner or one-ingredient type developer and a toner and carrier mixture or two-ingredient type developer. The developing device 5 electrostatically deposits the toner on the latent image. In the illustrative embodiment, the image transferring device includes a transfer charger and a separation charger that separates the sheet S from the drum 2. The fixing device 8 fixes the toner image on the sheet S with a heat roller and a press roller as usual.

The cleaning device 7 removes toner left on the drum 2 after image transfer with a blade 7A and then discharges the drum 2 with a quenching lamp 7B. The blade 7A may be replaced with, e.g., a fur brush, if desired. The drum 2 having its surface so cleaned again rotates toward the charger 3 for the next image forming cycle.

In FIG. 2B, the image forming apparatus is implemented as a tandem color printer 1'. As shown, the color printer 1' includes four image forming sections arranged side by side each for forming a toner image of a particular color. Such toner images of different colors are transferred to a sheet being conveyed by a belt 9 one above the other, completing a full-color image. More specifically, the image forming sections respectively include photoconductive drums 2Y (yellow), 2M (magenta), 2C (cyan) and 2B (black). A charger 2Y, an optical writing device 4Y, a developing device 5Y, an image transferring device 6Y and a cleaning device 7Y are arranged around the drum 2Y in the same manner as in FIG. 2A. Likewise, chargers 3M, 3C and 3M, optical writing devices 4M, 4C and 4B, developing devices 5M, 5C and 5B, image transferring devices 6M, 6C and 6B and cleaning devices 7M, 7C and 7B are respectively arranged around the drums 2M, 2C and 2B, as illustrated.

A fixing device, not shown, fixes the full-color image formed on the sheet. If desired, the belt 9 may be implemented as an intermediate image transfer belt, in which case the toner images of different colors will be transferred to a sheet by way of the belt 9 as conventional.

Each charger shown in FIG. 2A or 2B is made up of a charge roller or charging member and a facing member facing it and configured to cause discharge to occur between them. The following description will concentrate on the charger 3, FIG. 2A, by way of example.

Figure 3:
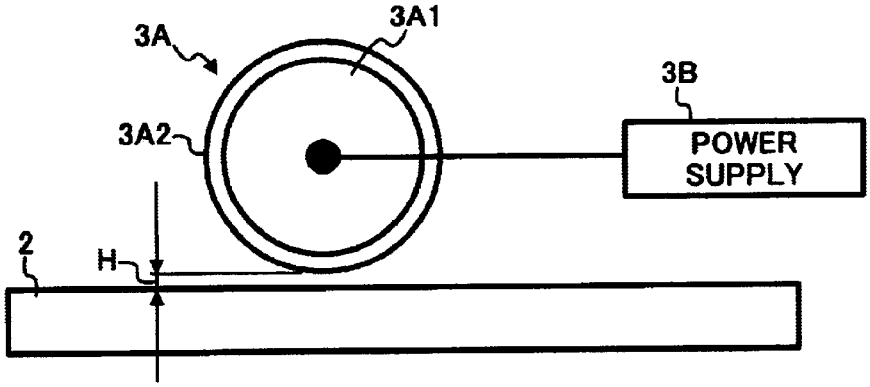
FIG. 3 shows a specific configuration of a charge roller included in the illustrative embodiment.

As shown in FIG. 3, the charger 3 includes a charge roller 3A made up of a conductive core 3A1 and a resistance layer 3A2 covering the core 3A1. The core 3A1 is a hollow cylinder having a diameter of 8 mm to 20 mm and formed of chrome stainless SUS define by JIS (Japanese Industrial Standards). The resistance layer 3A2 is made up of a epichlorohydrin rubber layer and a resin layer covering it. If desired, the resistance layer 3A2 may be implemented as a resin tube having thickness of 30 $\mu$m to 700 $\mu$mm and surface roughness Rz of 0.2 $\mu$m to 2 $\mu$m. The major component of the resin tube may be 4-ethylene fluoride copolymer, polyvinylidene fluoride, 4-ethylene fluoride perfluoroalkylvinyl ether copolymer or similar fluorocarbon resin or any other material so long as it can effect uniform charging.

The charge roller 3A moves in the same direction as the drum 2, as seen at the position where the former adjoins the latter. The charge roller 3A has an axial dimension slightly greater than about 300 mm, which is the size of a sheet of format A4 fed in a landscape position and the maximum sheet size applicable to the apparatus. In the illustrative embodiment, the charge roller 3A has hardness ranging from 30° to 80° in JIS A-scale. Because the charge roller 3A does not have to contact the drum 2, its hardness may be as high as 60° to 80° or above when consideration is given to durability.

Spacers 3C (see FIG. 4) are mounted on opposite end portions of the charge roller 3A for setting up a small gap H shown in FIG. 3 between the charge roller 3A and the drum 2. The gap H is between 5 $\mu$m and 100 $\mu$m at the position where the charge roller 3A is closest to the drum 2. To enhance the effect of discharge, the gap H should preferably be between 10 $\mu$m and 70 $\mu$m and is selected to be 50 $\mu$m in the illustrative embodiment.

A power supply 3B is connected to the charge roller 3A such that gaseous discharge occurs in the gap H between the surface of the drum 2 and that of the charge roller 3A to thereby uniformly charge the surface of the drum 2. While a bias applied from the power supply to the charge roller 3A is a DC voltage subjected to constant current control, the DC voltage may be replaced with an AC-biased DC voltage, if desired. The DC voltage is advantageous over the AC-biased DC voltage in that it produces only a small amount of discharge products.

A facing member 10 contacts or adjoins the charge roller 3A for removing silica, paper dust and other impurities deposited on the charge roller 3A. Specific configurations of the facing member 10 will be described with reference to FIGS. 4 through 8.

Figure 4:
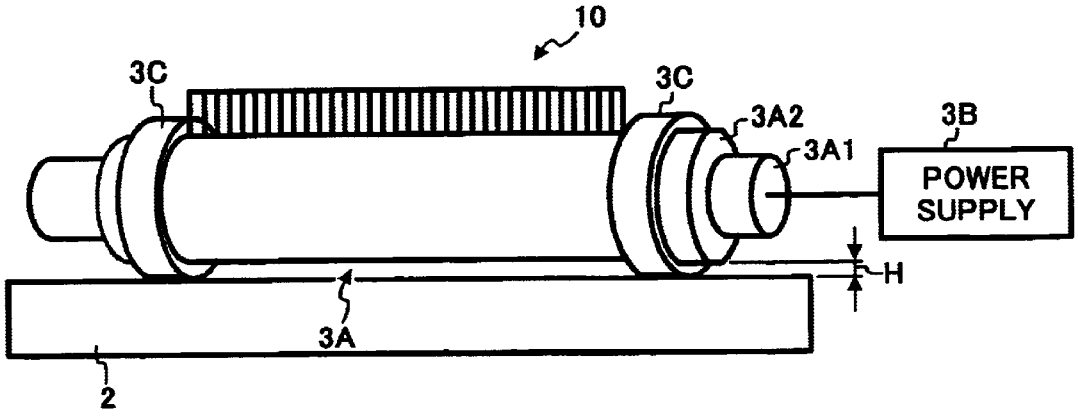
FIG. 4 shows a specific configuration of a facing member facing the charge roller.
Figure 5:
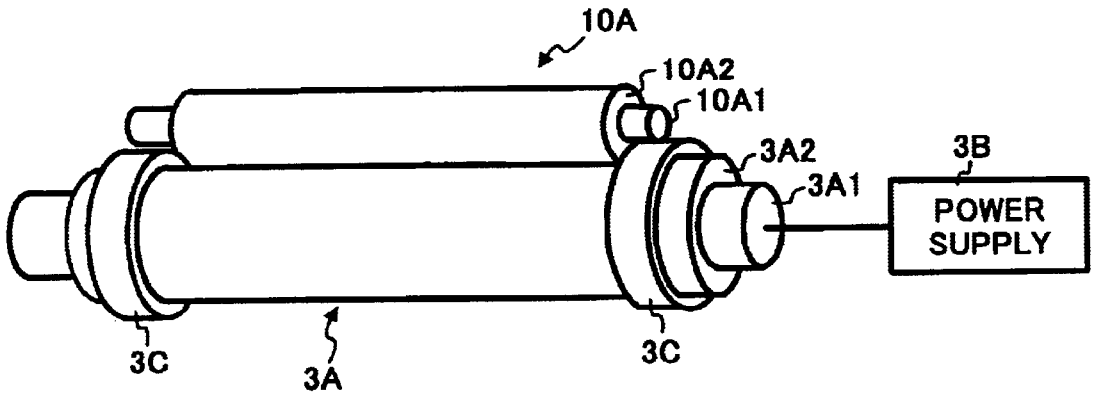
FIG. 5 shows another specific configuration of the facing member.
Figure 6:
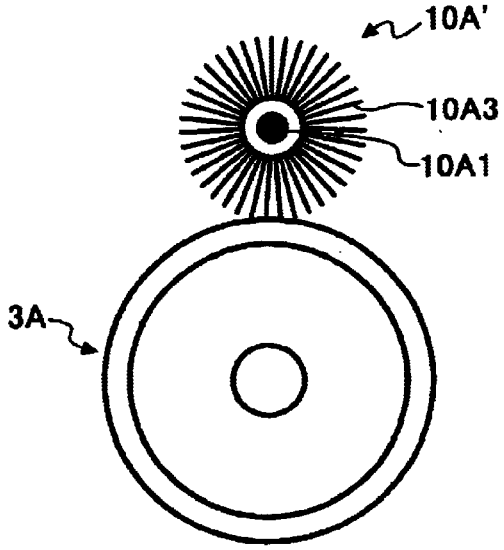
FIG. 6 shows still another specific configuration of the facing member.

In FIG. 4, the facing member 10 is implemented as a block of conductive sponge or conductive rubber or a conductive brush having medium resistance. In FIG. 5, the facing member 10 is implemented as a rotatable roller 10A made up of a metal rod or core 10A1 and a conductive rubber layer 10A2 formed on the metal rod 10A1. In FIG. 6, the facing member 10 is implemented as a brush roller 10A' having a number of filaments implanted in a core 10A1. The circumferential length of the facing member 10A or 10A' should preferably be not an integral multiple, so that the same portion of the facing member 10A or 10A' in the circumferential direction does not contact the charge roller 3A. More specifically, such a circumferential length prevents the same portion of the facing member 10A or 10A' in the circumferential direction from constantly facing the charge roller 3A. This successfully obviates an occurrence that the impurities are removed from only a limited portion of the charge roller 3A in the circumferential direction, The facing member 10A, FIG. 5, should preferably have a porous surface. Sponge, in particular, can easily retain silica and paper dust transferred from the charge roller 3A to the facing member 10A and can surely prevent them from being again returned to the charge roller 3A.

Why the facing member 10 is formed of a material having medium resistance is that such a material promotes gaseous discharge between the facing member 10 and the charge roller 3A for thereby effecting removal the impurities from the charge roller 3A.

I conducted a series of experiments with a medium resistance member in order to see the removal of the impurities from the charge roller 3A. For experiments, two different kinds of brush rollers 10A', FIG. 6, were prepared, i.e., an insulative brush roller and a brush roller having medium resistance. FIG. 9 shows the results of experiments. Use was made of the previously mentioned modified version of imagio 450 and a bias implemented as a DC voltage (identical with charge potential) biased by an AC voltage (constant current control). An image forming cycle was repeated with the above copier in a condition wherein the cleaning device was mounted and a condition wherein it was removed.

As shown in FIG. 9, when the insulative brush was held in contact with the charge roller 3A, part of the charge roller 3A whitened. When the whitened portion of the charge roller 3A was shaved off and analyzed, it was found to contain Si and Ca derived from silica and paper dust. This indicated that silica and paper dust still left on the charge roller 3A. By contrast, when the brush with medium resistance was held in contact with the charge roller 3A, the surface of the charge roller 3A remained the same as at the beginning of operation even after the formation of 5,000 images.

Apart from the variation of the surface of the charge roller 3A, I observed a phenomenon to occur between the charge roller 3A and the brush roller 10A' during image formation by using the insulative brush and medium resistance brush. Specifically, while applying a bias to the charge roller 3A without effecting image formation, I observed the surface of the charge roller 3A and that of the brush roller 10A' in the dark. Light ascribable to discharge was observed in the case of the medium resistance brush, but was not observed in the case of the insulative brush. The experiments therefore proved that the medium resistance member promoted discharge between the charge roller 3A and the facing member 10 and allowed the latter to surely electrostatically collect impurities from the former. Particularly, the medium resistance member differs from metal or similar conductive material in that it does not cause discharge with great energy to occur. This, coupled with the fact that the medium resistance member does not bring about charge-up particular to an insulative member, insures stable discharge without adversely effecting the charge roller 3A. Discharge with great energy would produce a discharge mark on the charge roller, destroy the charge roller or otherwise adversely effect the charge roller.

The facing member 10 contacting the charge roller 3A should preferably be pressed against the charge roller 3A for the following reason. Discharge between the charge roller 3A and facing member 10 occurs in the small gap therebetween. By holding the facing member 10 in contact with the charge roller 3A, it is possible to maintain the small gap. In addition, by pressing the facing member 10 against the charge roller 3A, it is possible to constantly maintain them ready to discharge even when vibration is transferred from the drum 2 to the facing member 10 via the charge roller 3A.

The facing members 10A and 10A' shown in FIGS. 5 and 6, respectively, each are rotated by the charge roller 3A. This prevents only a limited portion of the facing member 10A or 10A' from constantly facing the charge roller 3A and thereby frees the facing member 10A or 10A' from local deformation, i.e., local mechanical deterioration.

As shown in FIG. 7, the brush roller or facing member 10A' shown in FIG. 6 may be connected to ground so as to be capable of effecting discharge at all times. In this modification, the brush roller 10A' is not in an electrically floating state and therefore prevents charge from accumulating and bringing about charge-up. In this condition, the brush roller 10A' can continuously remove impurities from the charge roller 3A in a desirable manner.

Further, as shown in FIG. 8, a bias power source 11 maybe connected to the brush roller or facing member 10A'. A high voltage opposite in polarity to the voltage applied to the charge roller 3A is applied from the power supply 11 to the brush roller 10A', so that the brush roller 10A' can easily, electrostatically attract silica away from the charge roller 3A. This optimizes discharge between the facing member 10 and the charge roller 3A for the removal of impurities.

I compared, in the same conditions as in FIG. 9, the configurations shown in FIGS. 7 and 8, a configuration simply including an insulative brush roller and a configuration lacking the facing member 10 as to electric characteristic. FIG. 10 shows the results of comparison. As FIG. 10 indicates, the facing member 10A' cleans the charge roller 3A more effectively when connected to ground or even more effectively when applied with the bias. This is presumably because the facing member 10A' connected to ground is free from charge-up and disturbance to an electric field distribution that make discharge unstable.

The bias applied to the facing member 10A' makes discharge more stable and therefore enhances efficient cleaning. It follows that the discharge can remove silica and paper dust more efficiently and more surely than mechanical removal.

The charge roller 3A may, of course, be replaced with any other suitable charging member, e.g., a charge belt.

In summary, it will be seen that the present invention provides a charger and an image forming apparatus having various unprecedented advantages, as enumerated below.

(1) Discharge occurs between the charge roller and a facing member and causes the facing member to electrostatically collect silica, paper dust and other fine impurities from the charge roller. It is therefore possible to obviate the variation of resistance of the charge roller, which would make bias control sophisticated, and irregular charging ascribable to impurities. This can be done without increasing the cost of the apparatus.

(2) The facing member is formed of a medium resistance material and insures stable discharge while obviating great discharge particular to, e.g., metal. In addition, the facing member formed of such a material does not bring about charge-up particular to an insulator. Stable discharge simplifies bias control.

(3) Because the facing member is held in contact with the charge roller, a fine gap necessary for discharge is guaranteed. This promotes the electrostatic collection of impurities. The facing member may be pressed against the charge roller.

(4) The facing member is rotatable and therefore does not face the charge roller only at its limited portion. This prevents only part of the facing member from being deteriorated due to discharge. Consequently, the charge roller is evenly subjected to discharge over its entire circumference and can therefore collect impurities over the entire circumference.

(5) The facing member is connected to ground and not electrically floating with respect to the charge roller. This also insures discharge between the facing member and the charge roller and therefore the collection of impurities.

(6) A bias is applied to the facing member for stabilizing discharge. Particularly, the bias forms a discharge electric field in accordance with the electric resistance of impurities deposited on the charge roller, insuring the collection of impurities.

(7) The rotatable facing member capable of collecting impurities over its entire circumference is formed of an elastic material. The facing member therefore guarantees a nip width for electrostatic collection as well as the fine gap for discharge when contacting the charge roller. This increases the amount of impurities to be removed from the charge roller and implements desirable discharge.

(8) The surface of the facing member implemented as a roller is formed of a porous material so as to surely retain silica, paper dust and other impurities collected from the charge roller.

(9) The facing member can softly contact the charge roller when implemented as a brush. The brush does not press impurities deposited on the charge roller and therefore allows impurities to be easily removed from the charge roller.

(10) The charge roller can uniformly charge the surface of an image carrier without resorting to sophisticated bias control or an extra cost, surely obviating defective images ascribable to defective charging.

(11) When a plurality of images are transferred one above the other, impurities transferred from image carriers to charge rollers are surely removed. This obviates irregular charging ascribable to the variation of charge potential in each image transferring step and therefore reverse transfer of toner, thereby insuring high-quality images.

Various modifications will become possible for those skilled in the art after receiving the teachings of the present disclosure without departing from the scope thereof.

What is claimed is:

1. A charger comprising:

a charging member configured to charge an image carrier, said charging member being positioned to contact or adjoin said image; and a conductive facing member configured to clean said charging member, said facing member comprising a rotary member having a circumferential length which is not an integral multiple of a circumferential length of said charging member such that a same portion of said facing member does not constantly contact a same portion of said charging member, and said facing member being positioned to face a portion of said charging member other than a portion of said charging member that faces the image carrier, wherein discharge occurs between said charging member and said facing member to thereby remove impurities deposited on said charging member.

2. The charger as claimed in claim 1, wherein said facing member is held in contact with said charging member.

3. The charger as claimed in claim 2, wherein said facing member is pressed against said charging member.

4. The charger as claimed in claim 3, wherein said facing member is connected to ground.

5. The charger as claimed in claim 3, wherein a bias is applied to said facing member.

6. The charger as claimed in claim 2, wherein said facing member is connected to ground.

7. The charger as claimed in claim 2, wherein a bias is applied to said facing member.

8. The charger as claimed in claim 1, wherein said facing member is pressed against said charging member.

9. The charger as claimed in claim 1, wherein a bias is applied to said facing member.

10. The charger as claimed in claim 1, wherein said facing member comprises a brush and is connected to ground.

11. The charger as claimed in claim 10, wherein said facing member is held in contact with said charging member.

12. The charger as claimed in claim 11, wherein said facing member is pressed against said charging member.

13. The charger as claimed in claim 1, wherein said facing member comprises a brush and a bias is applied to said facing member.

14. The charger as claimed in claim 13, wherein said facing member is held in contact with said charging member.

15. The charger as claimed in claim 14, wherein said facing member is pressed against said charging member.

16. An image forming apparatus comprising:

an image carrier on which a latent image is to be electrostatically formed; and a charger comprising a charging member configured to charge said image carrier, said charging member being positioned to contact or adjoin said image carrier, and a conductive facing member configured to clean said charging member, said facing member comprising a rotary member having a circumferential length which is not an integral multiple of a circumferential length of said charging member such that a same portion of said facing member does not constantly contact a same portion of said charging member, and said facing member being positioned to face a portion of said charging member other than a portion of said charging member that faces said image carrier, wherein discharge occurs between said charging member and said facing member to thereby remove impurities deposited on said charging member.

17. The apparatus as claimed in claim 16, wherein a plurality of images are transferred one above the other.

18. A method of charging an image carrier, comprising:

causing a charging member to contact or adjoin the image carrier;

causing a facing member configured to clean said charging member to face a portion of said charging member other than a portion of said charging member that faces the image carrier, said facing member comprising a rotary member having a circumferential length which is not an integral multiple of a circumferential length of said charging member such that a same portion of said facing member does not constantly contact a same portion of said charging member; and causing discharge to occur between said charging member and said facing member for thereby removing impurities deposited on said charging member.

* * * * *